United States Patent [19]

Reiling et al.

[11] Patent Number: 5,062,341

[45] Date of Patent: Nov. 5, 1991

[54] PORTABLE DRUM SOUND SIMULATOR GENERATING MULTIPLE SOUNDS

[75] Inventors: Victor G. Reiling, West Cornwell; Bryan L. Dean, Torrington, both of Conn.

[73] Assignee: Nasta International, Inc., New York, N.Y.

[21] Appl. No.: 458,601

[22] Filed: Dec. 29, 1989

Related U.S. Application Data

[63] Continuation-in-part of Ser. No. 333,879, Mar. 31, 1989, Pat. No. 4,909,117, which is a continuation of Ser. No. 149,656, Jan. 28, 1989, abandoned.

[51] Int. Cl.[5] ..... G10H 1/057; G10H 5/00

[52] U.S. Cl. ..... 84/702; 84/738; 84/DIG. 12

[58] Field of Search ..... 84/671-690, 84/702, 703, 711, 422.4, 738, 739, 742, 477 R, DIG. 12; 446/242

[56] References Cited

U.S. PATENT DOCUMENTS 4,627,324 12/1986 Zwosta ..... 84/477 R X
4,776,253 10/1988 Downes ..... 446/242 X

FOREIGN PATENT DOCUMENTS 2183076 5/1987 United Kingdom ..... 84/422.4

*Primary Examiner*—Stanley J. Witkowski
*Attorney, Agent, or Firm*—Lackenbach Siegel Marzullo & Aronson

[57] ABSTRACT

A portable drum sound simulator is provided which includes an electronic drum sound generating means capable of generating a plurality of drum-like sound outputs and energizable in response to electrical trigger signals. Also included is a tone pitch varying means which varies by a plurality of steps the tone pitch of the drum-like sound outputs. A switch allows a user to select a desired drum-like sound output and another switch allows a user to select a desired tone pitch for the drum-like sound output. These two switches are each mounted on a respective drumstick each of which also includes a normally open electrical switch. These electrical switches are connected to the drum sound generating means and when closed causes a trigger circuit to develop a trigger signal which energizes the drum sound generating means so as to generate the drum-like sound output.

9 Claims, 10 Drawing Sheets

DRUM SOUND GEN. 70
NOISE GEN
NOISE AMP
TRIGGER AND ENVELOPE SHAPING 72
AUDIO AMPLIFIER 74
Vcc
Gnd
9V
36
28
34
8Ω
47K
AMPLITUDE (VOLTS)
TIME

RADIO
(TUNER/AMPLIFIER)
80
Vcc
GND
70, 72
74
82
84
85
86
88
76
16
62
63
28
36
34
Q1
Q2
Q3
Q4
Q5
Q6
Q7
Q8
Q9
Q10
R1
R2
R3
R4
R5
R6
R7
R8
R9
R10
R11
R12
R13
R14
R15
R16
R17
R18
C1
C2
C3
C4
C5
C6
C7
C8
C9
C10
C11
C12
C13
C14

PORTABLE DRUM SOUND SIMULATOR GENERATING MULTIPLE SOUNDS

RELATED APPLICATION

This application is a continuation-in-part patent application of our copending U.S. patent application, Ser. No. 07/333,879, filed Mar. 31, 1989 (now U.S. Pat. No. 4,909,117); which in turn is a continuation application U.S. Ser. No. 07/149,656, filed Jan. 28, 1989 (now abandoned).

BACKGROUND OF THE INVENTION

This invention relates generally to a drum sound simulator of the type which electronically produces a drum-like sound each time a drumstick connected to the simulator taps against a surface, and more particularly to a drum sound simulator which is portable and operates without need for an actual drum or striking of a surface. Drum beats are part of most music, from very primitive native music to sophisticated classical compositions and drums are often played in solo passages as part of an overall orchestral or modern music performance. Electronic keyboards are now available which can produce sounds claimed to be similar to every known type of instrument including classical instruments and more popular devices. New sounds are synthesized. These keyboards, while transportable and perhaps considered in a sense to be portable because they can be readily moved, are not in constructions which an individual would carry during a performance. The keyboards presently available generally attempt to suggest a piano keyboard and the operator or user thereof sits at a bench or chair as would a performer at a piano. A prior art device is disclosed in U.S. Pat. No. 2,655,071 wherein a drum sound is produced electronically whenever a performer taps on a modified drum with his drumsticks to complete a circuit between stick and drum. Because it is necessary to transport both the drum and the associated electronics, this device is not portable in the sense described, wherein the performer is completely free of his surroundings and can produce drum sounds without need for a drum, or as described more fully hereinafter, without need for a hard surface. The keyboards do not include circuits for interaction with other sound sources.

What is needed is a drum sound simulator which is entirely portable, can be carried by the performer and allows both solo performance and accompaniment of available audio musical sounds from broadcast or recorded sources.

Portable drum sound simulators are well-known, and includes applicants' own product as described in our parent application and as published in the counterpart Korean publication (89-12264) , as well as the counterpart U.K. patent (GB 2208027B). Also, the applicants' Drum Sound Simulator has been in the marketplace for over one year. Subsequent to the introduction of applicants' product in the market, other manufacturers have developed and marketed other drum sound simulator products. Other references of interest to the subject matter of the present invention are: "Build a Portable Synthesizer", *Radio-Electronics,* Vol. 47, No. 1, pp. 46–48, 82–85, January 1976; and the additional references noted by the applicants in the Information Disclosure Statement filed in the aforementioned parent application which are as follows:

| PATENT NO. | DATE | INVENTOR |
|---|---|---|
| 2,655,071 | 10-13-53 | Levay |
| 3,198,872 | 8-3-65 | Finkenbeiner |
| 3,509,264 | 4-28-70 | Green |
| 3,634,595 | 1-11-72 | Pasquali |
| 4,341,140 | 7-27-82 | Ishida |

Other references of interest are the Casio Sound Sticks article from *Consumer Reports* as cited by the Examiner in an Office Action in the parent application, *The Encyclopedia of Electronic Circuits* by Rudolf F. Graf, 1985, pp. 467–468, and the references as follows:

| | | |
|---|---|---|
| U.S. Pat. No. 4,776,253 | 10-88 | Downes |
| U.S. Pat. No. 3,053,949 | 9-62 | Johnson |
| U.S. Pat. No. 3,731,022 | 5-73 | Loftus |
| U.S. Pat. No. 4,418,598 | 12-83 | Klynas |
| U.S. Pat. No. 4,753,146 | 6-88 | Seiler |
| U.K.P. No. 2,183,076 | 5-87 | Tragen |

However, a portable drum sound simulator still does not exist which is capable of generating different drum sounds and different tone pitches for each drum sound; and which provides a user with a single and convenient instrument for changing from one simulated drum sound and tone pitch to a different simulated drum sound and tone pitch.

SUMMARY OF THE INVENTION

Generally speaking, the portable drum sound simulator, according to the invention, is especially suitable for carrying by the performer independently of its surroundings, is provided. This simulator comprises a pair of drumsticks having therein electrical switches which are actuated by a sudden change in motion or acceleration of the drumsticks, a person using the drumsticks moves them rapidly and abruptly stops them or reverses their direction of movement. The switches within the drumsticks are connected to a trigger circuit which develops trigger signal which initiate operation of a drum sound generator every time one or both of the switches in the respective drumsticks is closed as described above. The drum sound signal is inputted to an audio amplifier which drives a loudspeaker producing an audible sound, similar to that produced by an actual drum. The trigger circuit, drum sound generator, audio amplifier and loudspeaker are all contained in a small enclosure or case which provides access to an ON/OFF volume control knob and allows for connection by wires between the drumsticks and the circuits within the enclosure. A battery within the enclosure activates the circuits and makes the unit entirely self-contained and completely portable.

In an alternative embodiment, a radio receiver is also included within the enclosure, whereby it is possible to use the device as an independent radio, an independent drum sound simulator as described above, or a device which combines the radio signal with the operator produced drum signals such that the operator can accompany on the drums, by simulation, the music played on the radio. An externally operated switch allows selection between these three modes.

Accordingly, it is an object of this invention to provide an improved drum sound simulator which is entirely portable and independent of its surroundings, being carriable by the user in performance.

Another object of this invention is to provide an improved drum simulator which includes drumsticks similar to actual drumsticks and operates without need for an actual drum.

A further object of this invention is to provide an improved drum sound simulator which serves as either a simulated drum, a radio, or a drum accompanying a broadcast or a recorded performance. Still another object of this invention is to provide an improved drum simulator, where the manipulation of drumsticks initiates the simulated drum sounds.

Still a further object of this invention is to provide a portable drum sound simulator capable of generating a plurality of simulated different drum sounds, such as tom tom, snare drum, syn tom and high bongo.

Yet another object of this invention is to provide a portable simulator capable of developing a plurality of tone pitches to vary the pitch of generated simulated drum sounds.

A further object of the invention is to provide a portable drum sound simulator which allows a user to easily and conveniently change from one drum sound and tone pitch to others.

Still another object of this invention is to provide a portable drum sound simulator in which a plurality of simulated drum sounds and tone pitches are generated by noise and tone generating circuitry provided in an integrated circuit.

Still other objects and advantages of the invention will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
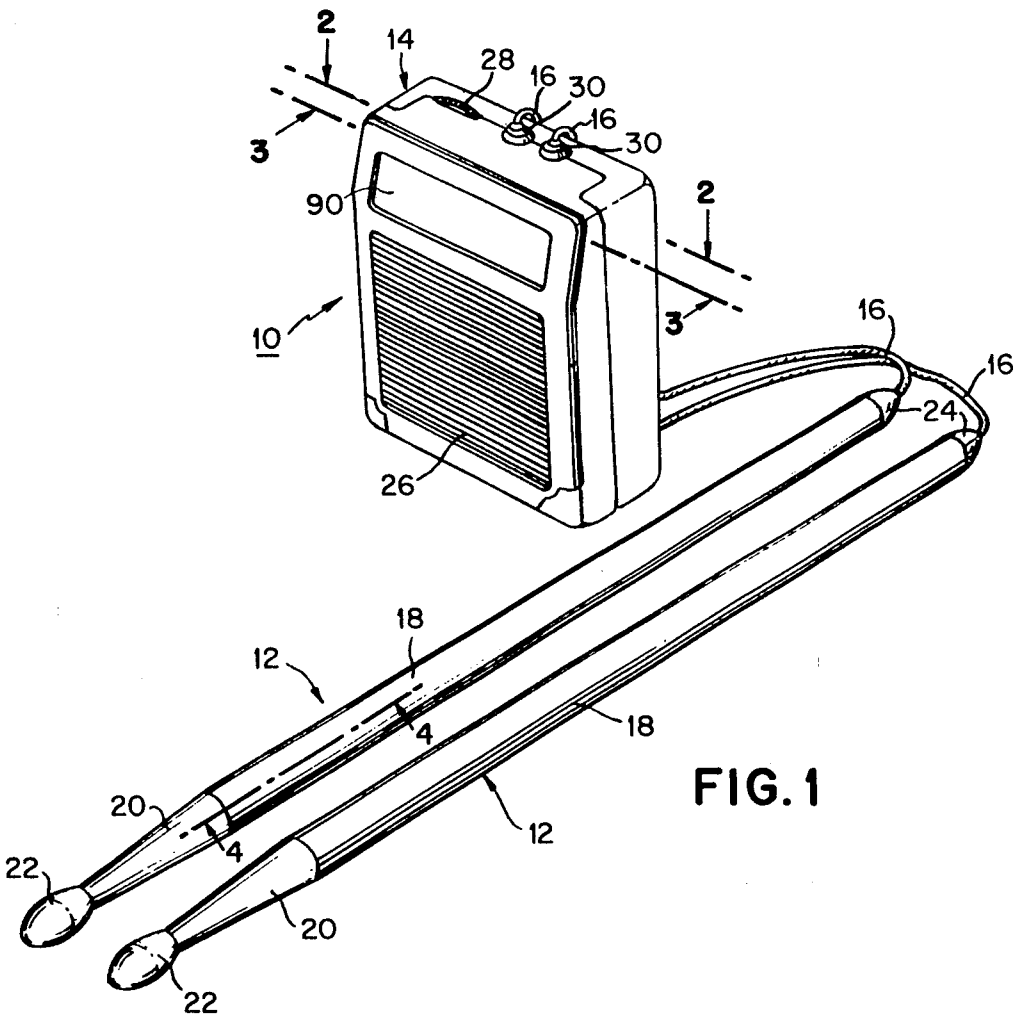
FIG. 1 is a perspective view of a portable drum sound simulator in accordance with the invention.
Figure 2:
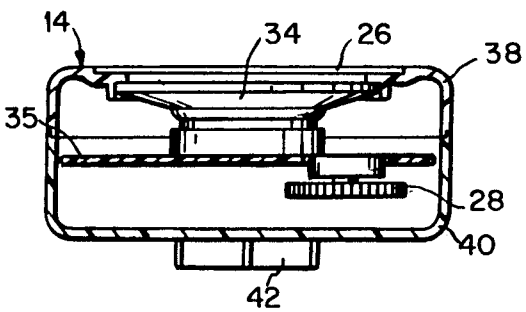
FIG. 2 is a top sectional view taken along the line 2—2 of FIG. 1.
Figure 3:
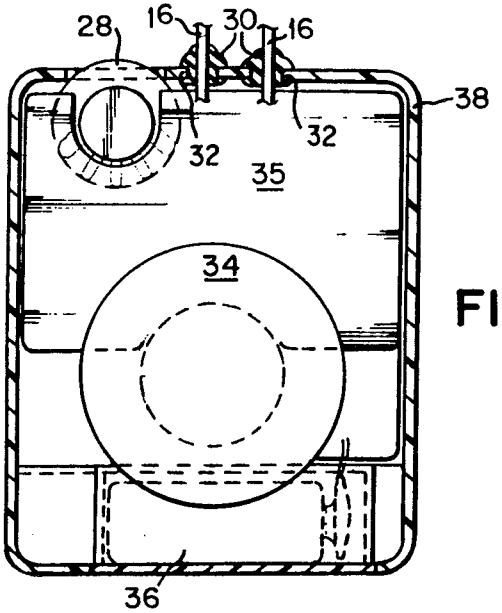
FIG. 3 is a front sectional view taken along the line 3—3 of FIG. 1.

With reference to the drawing, the drum sound simulator of this invention includes two drumsticks 12 connected to an enclosure or case 14 by means of individual leads 16 or cords. The drumsticks 12 are similar in size and appearance to authentic drumsticks. Each drumstick 12 comprises a rigid plastic tube 18 with a soft plastic tip 20 to cover the striking end of the drumstick. The soft plastic tip 20 extends from the striking end 22 approximately 25% of the total drumstick length. At the handle end of the drumstick 12, a soft plastic end cap 24 restrains the lead or cord 16 where it exits from the drumstick.

The enclosure or case 14 includes a loudspeaker grill cover 26, an ON/OFF switch combined with a volume control 28, and a pair of soft plastic rings 30, where the cords 16 enter the enclosure 14 through openings 32 in the enclosure 14.

Inside the enclosure 14 are disposed a loudspeaker 34 mounted to output sound through the grill 26, the ON-/OFF/volume control 28 is of a conventional type including a partially visible knob, rheostat and built-in switch. Also included within the enclosure 14 are a printed circuit board 35 for the electronic circuits of the drum sound simulator in accordance with the invention, and a battery 36 which power to the electronic circuits. The enclosure 14 is in two halves, namely a front half 38 and a rear half 40. A belt clip 42 is fixedly attached to the rear half 40. This clip slips over the belt of a person carrying the simulator in accordance with the invention so that the user's hands are entirely free for manipulation of the drumsticks 12.

The dimensions of the enclosure 14 accommodate portability, and minimum size is only limited by the electronic components which are available for packaging in the enclosure. Thus, an enclosure 14 which is readily held in the palm of the hand, can be produced. However, increased battery holding capacity and a larger loudspeaker which enhances sound quality, can be used in larger versions which are still entirely portable in the sense that they can be attached to the body of the user. For example, the belt clip 42, as illustrated, or shoulder straps, etc., which still leave the user's hands free to manipulate the drumsticks 12, can also be used. Also, an external handle or straps (not shown) can be provided on the enclosure 14 or on a lightweight carrying case for the enclosure to enable portability. When not carried, the device is easily placed on any surface so that the user may freely manipulate both drumsticks. As described hereinafter, operation with a single drumstick is also possible with the device. As is conventional with portable radios, cassette players, hand and desk calculators, etc. etc., the drum sound simulator in accordance with the invention can be adapted for use with an external source of power in addition to its electric capability provided by the internal battery 36. Jacks (not shown) can be provided to allow use of earplugs or earphones.

Figure 4:
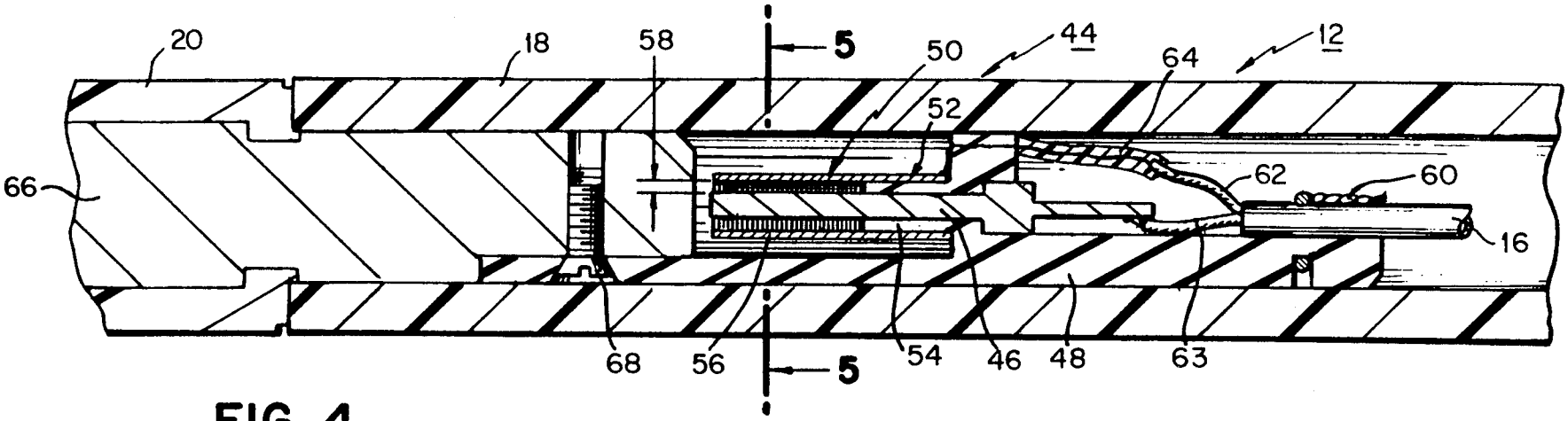
FIG. 4 is a sectional view of the drumstick taken along the line 4—4 of FIG. 1.
Figure 5:
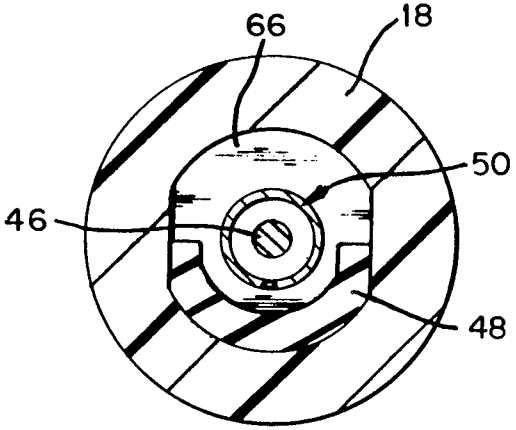
FIG. 5 is a view taken along the line 5—5 of FIG. 4.

As best illustrated in FIGS. 4 and 5, an inertial switch 44 is mounted within the rigid tube 18 of each drumstick 12. The switch 44 includes an electrically conductive metal shaft 46 mounted in a non-conductive holder 48 and concentrically surrounded by a circular coil spring 50. The spring 50 is mounted at one end 52 around a protruding portion 54 of the holder 48. The spring 50 is coiled concentrically with the shaft 46 and is suspended as a cantilever beam which allows the other or free end 56 of the spring 50 to swing or oscillate about its fixed end 52 as described more fully hereinafter. The resilience of the cantilevered spring 50 depends on the spring wire from which it is fabricated and the closeness of the turns. As illustrated, the turns are adjacent to one another and are sufficiently stiff such that in a static state, the switch spring 50 maintains a substantially uniform gap 58 between the spring 50 and the shaft 46. The magnitude of the gap is determined by the circumference of the protruding portion 54 of the holder 48.

The external cord 16 passes through the hollow tube 18 and is anchored to the holder 48 by a metal wire tie 60. Two electrical wires 62, 63 extend from the cord 16. The wire 63 connects to a rear extension of the metal shaft 46, whereas the wire 62 connects to the spring coil 50 by way of a hollow insulating tube 64. A rigid core 66 fills the soft tip 20 and extends between the tip 20 and the tube 18 to provide a basically rigid structure covered by the soft tip 20. A machine screw 68 fixedly connects the holder 48 to the core 66. The core 66 is a press fit within the tube 18. In alternative embodiments, for examples, adhesives may be used for this connection or a screw through the tube 18 can engage the core 66.

The spring 50 maintains its relationship with the metal shaft 46, that is, spaced apart, so long as the stick 12 remains in a static condition or is moving without acceleration or deceleration. When the stick 12 is moved briskly, that is, stick motion is abruptly changed, for examples, as in striking a surface as one would strike a drum in a conventional manner, or in "striking" the air by abruptly interrupting motion in one direction of the stick 12 with a motion in the opposite direction, the switch 44 closes. In particular, with these sudden changes in motion, the momentum of the spring causes the spring coils to separate slightly resulting in an elastic deflection or swinging of the free end 56 of the spring 50 toward the metal shaft 46. When the spring 50 and shaft 46 make contact, an electrical circuit is completed through the switch 44. Contact is maintained only momentarily before the spring 50 resumes its original spaced apart position relative to the shaft 46, whereby continuity of the switch is opened. Individual or successive strikes with the stick 12 result in any number of momentary switch contacts as desired by the user. Each drumstick 12 contains such a switch 44 to which the circuits respond.

The spring 50 has a stiffness which prevents unintended drum sounds for light motions such as simply picking up or carrying the sticks. Spring stiffness also operates to damp spring oscillation and prevent output of plural drum sounds for single drum "strokes".

Figure 6:
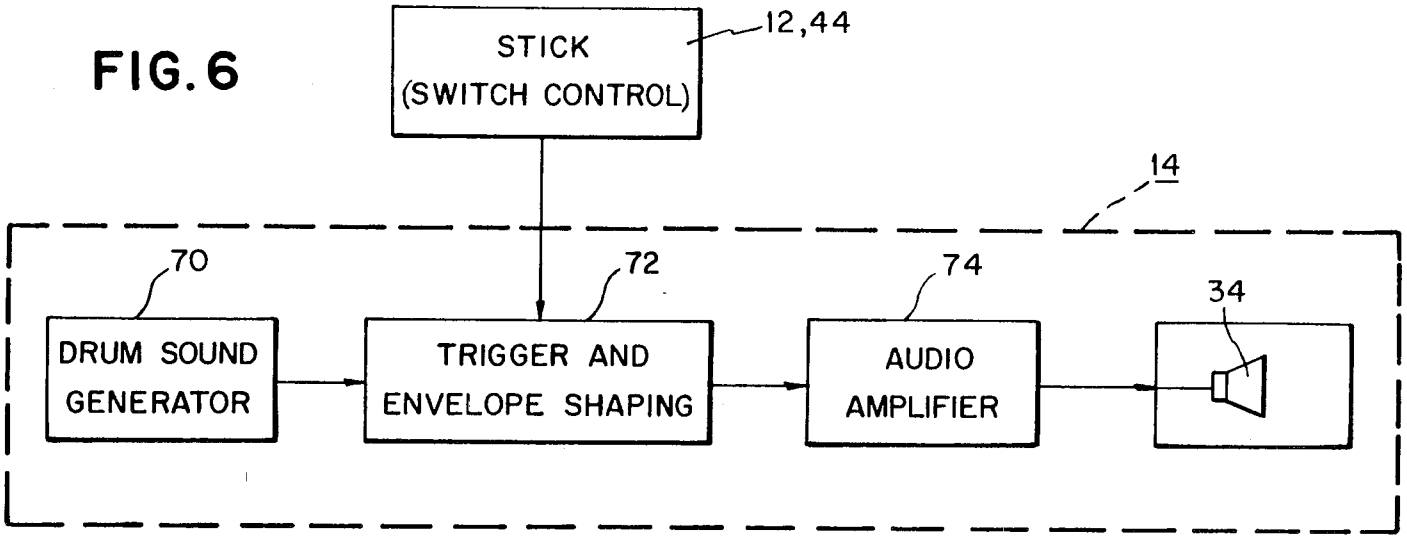
FIG. 6 is a functional block diagram of the portable drum sound simulator of FIG. 1.

As illustrated in FIG. 6, the drum stick 12 in combination with its internal switch 44, provides a trigger signal upon closing the switch 44. The trigger signal initiates operation of a drum sound generator 70 having an output which is shaped by a trigger and envelope shaping circuit 72 and fed to an audio amplifier 74 whose output drives a loudspeaker 34. Each closing of a switch 44 outputs a single drum sound from the speaker 34. The switches 44 are electrically connected in parallel.

Figures 7, 10:
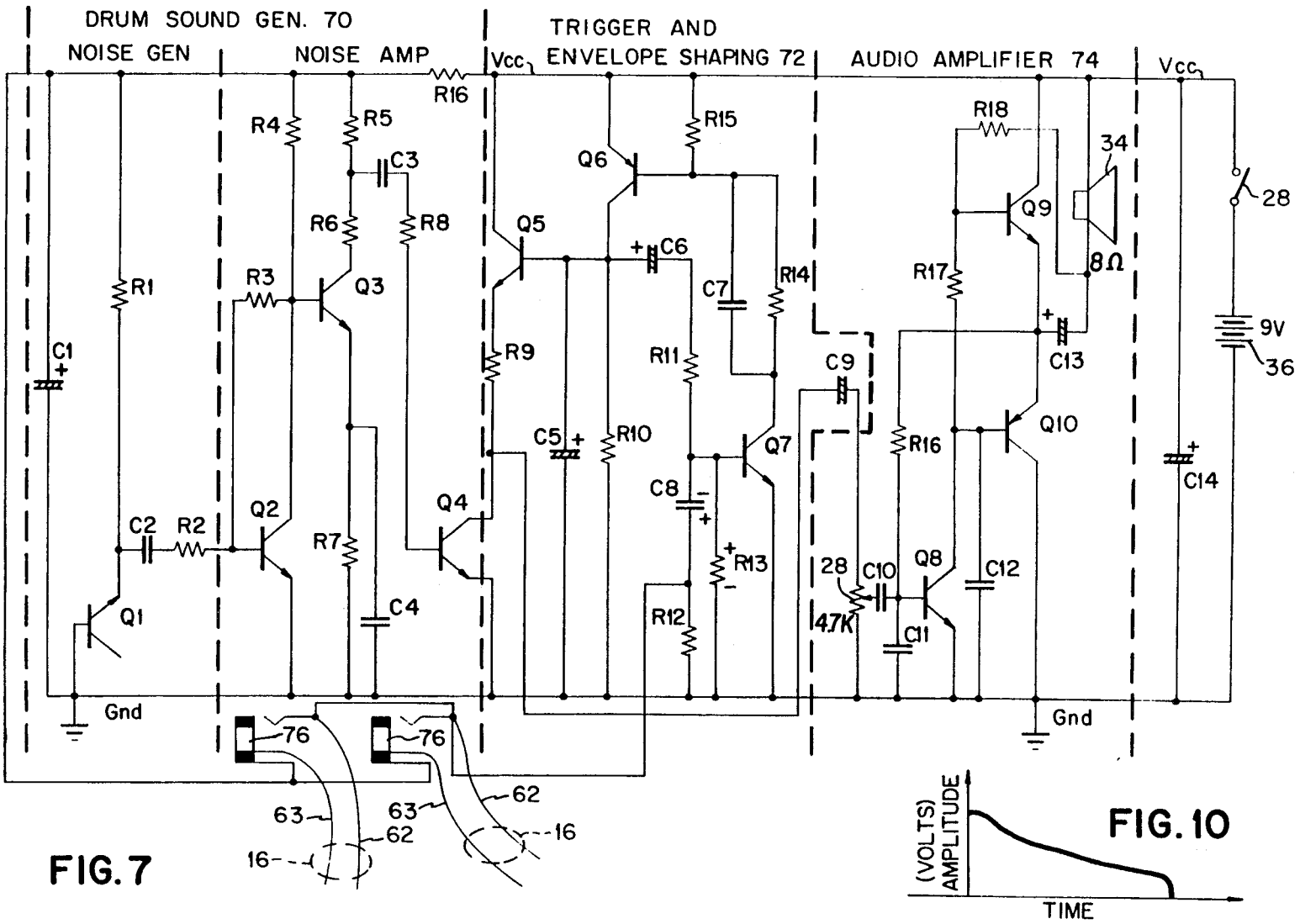
FIG. 7 is an electrical circuit schematic of the drum sound simulator, less drumsticks, of FIG. 1.
FIG. 10 illustrates an audio signal waveform from the drum sound generator in the circuits of FIGS. 7 and 8.

FIG. 7 is a circuit for analog operation in performing the functions illustrated in FIG. 6. This circuit includes the battery 36, outputting a voltage identified as $V_{cc}$ at its positive terminal and with its negative terminal connected to ground. Across the battery 36, with the intervening ON/OFF switch 28, is connected a filter capacitor C14. Also connected to the voltage $V_{cc}$ are one end of a resistor R15, the emitter of PNP (or P-type) transistor Q6, collector of NPN (or N-type) transistor Q5, and one end of resistor R16. The other end of resistor R15 connects to the base of a transistor Q6 and to one end of a capacitor C7 and a resistor R14. The other ends of the capacitor C7 and the resistor R14 are connected to the collector of a transistor Q7, having its emitter connected to ground. The collector of the transistor Q6 is connected to the base of the transistor Q5 and to one end of the capacitor C6, capacitor C5 and the resistor R10. The other end of the capacitor C5 and the resistor R10 are connected to ground and the other end of the capacitor C6 is connected to a resistor R11. The other end of the resistor R11 is connected to the base of the transistor Q7. Also connected to the base of the transistor Q7, are one end of a resistor R13 and a capacitor C8, the other end of the resistor R13 is grounded and the other end of the capacitor C8 connects to one end of a resistor R12 and to a pair of jacks 76 in parallel. The wires 62, 63 from the external cords 16 from the drumsticks 12 connect in parallel to the two sides of the jacks 76. The other end of the resistor R12 is grounded. The emitter of transistor Q5 connects to the collector of a transistor Q4 through a resistor R9 and the collector of the transistor Q4 is connected to one end of the capacitor C9 which couples the drum sound signal to an audio amplifier 74 as explained more fully hereinafter.

The emitter of the transistor Q4 is grounded and the base of the transistor Q4 connects to one end of the resistor R5 by way of the resistor R8 and a capacitor C3 in series. The other end of the resistor R5 connects to one end of a resistor R16. The other end of the resistor R16 connects to the positive terminal of the battery 36. A resistor R6 connects to the collector of the transistor Q3 and at the other end to the junction between the resistor R5 and the capacitor C3. The emitter of the transistor Q3 connects to ground by way of a resistor R7 and a capacitor C4 in parallel.

The base of transistor Q3 connects to the collector of transistor Q2 and to one end of resistor R4. The other end of resistor R4 connects to the positive terminal of the battery 36 through resistor R16. Resistor R3 connects between the base of transistor Q3 and the base of transistor Q2. Transistor Q2 has a grounded emitter. Transistor Q1 has its base grounded and its emitter connected to the base of transistor Q2 through capacitor C2 and resistor R2 in series. The emitter of transistor Q1 connects through resistor R1 to one end of resistor R4 and the end of resistor R16 away from the positive terminal of battery 36. The collector of the transistor Q1 is floating, that is, not connected.

Capacitor C1 connects between ground and the end of resistor R16 away from the positive battery terminal as does a lead from the jack terminal 76 to which the wires 63 from the drumsticks 12 are connected. As previously stated, the jack terminal is also connected to one end of capacitor C8.

The audio amplifier 74 is conventional in design and needs no further description herein. It is coupled to the drum sound generator 70 by the amplifier input capacitor C9 which connects between the transistor Q5 in an emitter follower circuit arrangement and the resistance in the volume control 28. It should be noted that when the switch 44 in the drumstick 12 closes, as described above by an abrupt change in motion, the capacitor C8 become connected at one end to the positive voltage $V_{cc}$ through resistor R16, the jack terminal 76, and leads 62, 63 which are shorted together by the closed switch 44. The other end of capacitor C8 is connected to ground through resistor R13. Thus, when the switch 44 in the drumstick 12 is momentarily closed, and it does not matter whether one switch 44 or both is closed since they are in parallel, the capacitor C8 charges momentarily to the voltage $V_{cc}$ to trigger the circuits.

The transistor Q1 and components R1, C2, R2 comprise a white noise generator. The white noise output of this generator is amplified by the transistor circuits Q2, Q3, Q4 with the parallel arrangement of resistor R7 and capacitor C4 forming a filter, limiting the frequency spectrum outputted from the amplifiers. Frequencies above 6000 Hz are substantially attenuated.

When a drumstick 12 strikes a surface or has a sudden change in motion, the switch 44 inside the stick 12 closes and capacitor C8 is momentarily charged to voltage $V_{cc}$. This causes a monostable circuit constructed around transistors Q7 and Q6 to provide an audio pulse output which is shaped by the R-C network C4, R7 to provide a triangular waveform (FIG. 10). The shaped pulse is coupled from emitter follower Q5 to the audio amplifier 74 by way of the amplifier input capacitor C9. This triangularly shaped signal output, limited in frequency by the high pass filter R7, C4, when further amplified in the audio amplifier 74 produces a sound from the loudspeaker 34 which simulates an actual drum. Each actuation of a switch 44 produces another drum sound output. Pulse width in the range of 25 to 100 milliseconds provides an effective drum sound simulator with a preference in the range of 50–60 milliseconds.

In alternative embodiments of a drum sound simulator in accordance with the invention, either or both components R7 and C4 may be variable by the user such that the frequency content of the audio envelope is variable to modify the quality of sound as is pleasing to the user. Any or all of C5, C6, R11 and R12 may be variable by the user in order to change the envelope shape and audible sound quality. In such an instance, one or more tone quality knobs similar to the volume control would be provided as needed on the enclosure 14 where accessible to the user, or screwdriver adjustment may be made available. Variable resistors are preferred over variable capacitors for economic reasons and because of the public's general use and acceptance of such controls on many electrical devices.

In a circuit which gives satisfactory performance, transistors Q1, Q2, Q3, Q4, Q5, Q7, and Q8 are N-type 9014C. Transistors Q6 and Q10 are P-type 9015C and 9012H, respectively. Transistor Q9 is N-type 9012H. In microfarads, capacitor C1 is 47, C2 equals 0.01, C3 equals 0.01, C4 equals, 0.1, C5 equals 10, C6 equals 1, C7 equals 1000, C8 equals 0.04 and C9 equals 1. In ohms, R1 equals 1 meg, R2 equals 10K, R3 equals 330K, R4 equals 18K, R5 equals 8.2K, R6 equals 2.2K, R7 equals 20K, R8 equals 3.3K, R9 equals 5.6K, R10 equals 2.2K, R11 equals 470, R12 equals 8.2K, R13 equals 10K, R14 equals 1K, R15 equals 1K and R16 equals 220. Commercial quality and tolerances apply to these nominal values.

As stated, audio amplifier 74 is conventional and requires no description herein. Other audio amplifier circuits of conventional type are suitable to receive the output from coupling capacitor C9.

It should be understood that in an alternative embodiment of a portable drum sound simulator in accordance with the invention, the analog circuits 70, 72 (FIG. 7) can be replaced by a digital synthesizer circuit (not shown) wherein an actual drum sound waveform has been digitized with respect to time in a conventional manner and the drum sound data is stored at separate addresses in memory means, for example, a read only memory. To obtain the digitized data for storage, the drum sound waveform is essentially broken into small time intervals, and a numeric value is assigned to each time interval, which value corresponds to the amplitude of the waveform in that interval. These values are digitized in binary format and stored. When the circuits are triggered by closing the switch 44 in a drumstick 12, the data is read out of the memory addresses in a desired sequence and the binary numbers at each memory address, are converted in a digital to analog converter to an analog signal which is applied to the input of the audio amplifier 74. The data which is originally stored in the memory is preferably derived from an actual drum sound. The elements for this digital sound synthesizer may be mounted on the same printed circuit board 35 in the enclosure 14.

Figure 8:
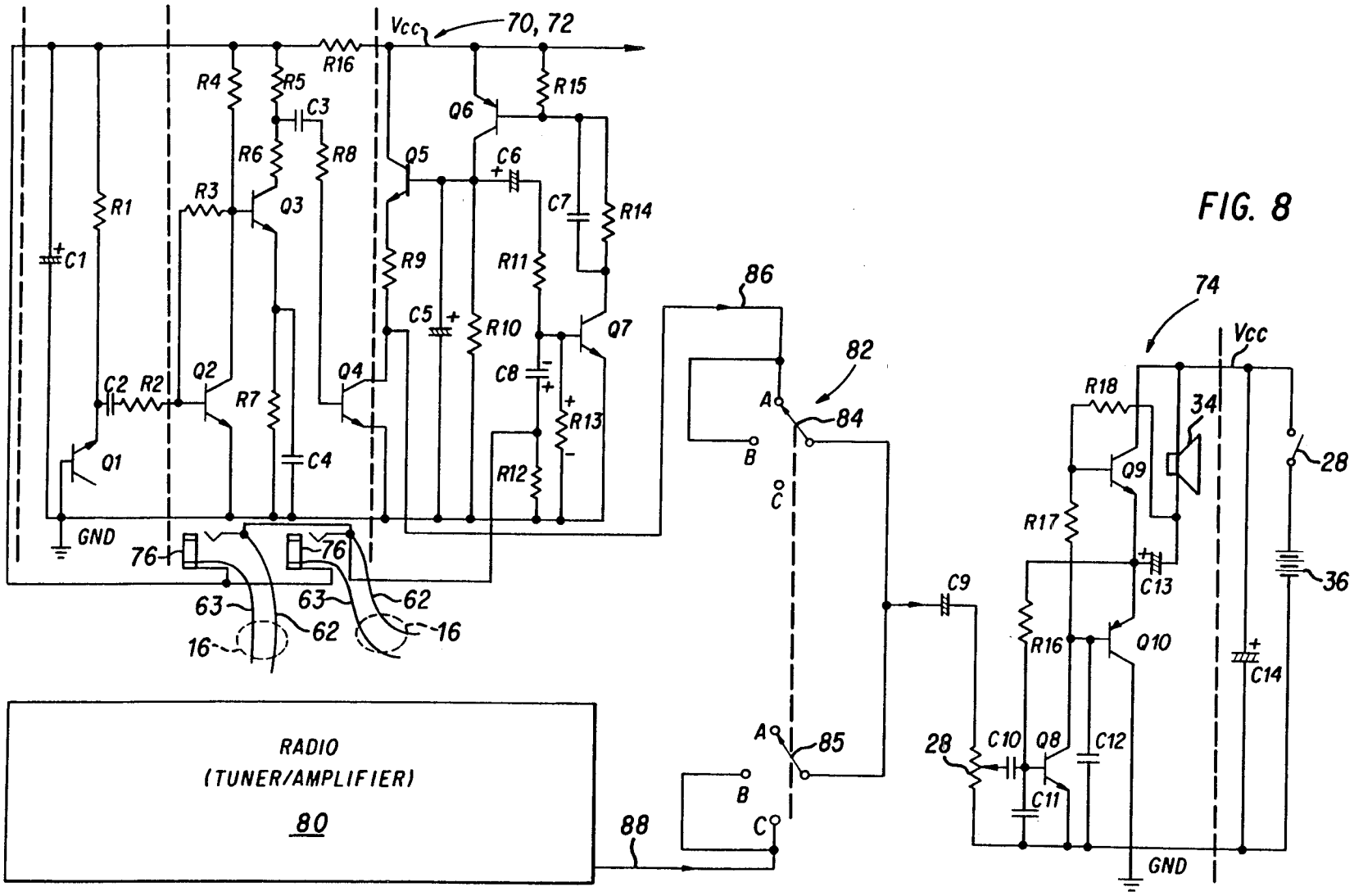
FIG. 8 is an alternative circuit schematic similar to FIG. 7 and including a radio receiver and switching network.

In another alternative embodiment of a portable drum sound simulator in accordance with the invention, as shown in FIG. 8, a radio 80, less its final audio amplification and loudspeaker stages, is combined with a two-pole, three position, ganged mode selector switch 82. Poles 84, 85 of the switch 82 move in synchronism in a conventional manner to selectively make connection with associated contacts a, b, and c of the switch, as illustrated. The output 86 of the sound generator circuits connects to contacts a and b associated with pole 84, whereas the output of the radio 80 connects to contacts b and c associated with the pole 85. The poles 84, 85 are connected in parallel to the input of the audio amplifier 74 at the capacitor C9. Thus, when the poles 84, 85 are at position a, the drum sound generator 70, 72 is connected to the audio amplifier 74, whereas the radio output is blocked. With the poles 84, 85 at position b, the output 86 from the drum sound generator 70, 72 is inputted to the audio amplifier 74 along with the audio output from the radio. Thus, a user of this simulator can accompany the radio sounds with his own drumbeats. With the poles 84, 85 at position c, the drum sound signal generator 70, 72 is blocked from the audio amplifier 74, but the radio output 88 is coupled to the audio amplifier 74 and the user may listen to the radio without any self-generated accompaniment.

The radio circuits, which may be either or both AM and FM, may be incorporated on the printed circuit board 35 with addition of a variable tuning capacitor in the enclosure 14 as is conventional in such radios. The station frequency indicator, that is, a dial, may appear in the enclosure panel 90, as shown in FIG. 1, with a tuning knob similar to the volume control knob 28 also protruding from another opening in the enclosure.

In alternative embodiments in accordance with the invention, the drum sound generator circuits 70, 72 in FIG. 8, can be replaced with a digital synthesizer operating on internally stored data, as discussed above. The radio 80 may be replaced by an audio cassette player which is accommodated into a modified enclosure 14. Digitized audio tapes are coming on the market and a player for such tapes may be used where the radio 80 is indicated in FIG. 8. Similarly, compact disk players of portable design may be used. All combinations of circuits for drum sound generation with broadcast, stored and recorded music reproduction may be combined in an arrangement as indicated in FIG. 8, where the user can choose between listening to recorded, stored or broadcast music, his own generated drum sounds, or a combination of recorded, stored or broadcast music and his own generated drum sounds.

Also, in alternative embodiments in accordance with the invention, the three-position ganged switch 82 (FIG. 8) may be replaced by a larger switch including more contact positions and/or more poles so that many more functions and combinations may be accommodated. For example, many electronic keyboard instruments now on the market include synthesized rhythm beats, which may be sorted in digitized format, or analog. The stored rhythms, for example, waltz, march, jitterbug, etc., can be selectively reproduced audibly while at the same time, the user of the instrument is playing the keyboard which is selectively set to produce one of many instrument sounds. Such a stored rhythm capability can be provided in the enclosure 14 whereby a user of the device can use the drumsticks in conjunction with a prestored rhythm beat just as easily as the radio sound, for example, may be selected for accompaniment as described above. It should also be understood that, with an enlarged switch capability, all of these sound producers may be available to the user in multiple combinations or solo. Thus, the device can include the AM radio, FM radio, stored rhythm capability, audio cassette capability, compact disk capability, etc., etc. All such combinations with the drum sound simulator are considered to fall within the scope of the claimed invention.

Figure 9:
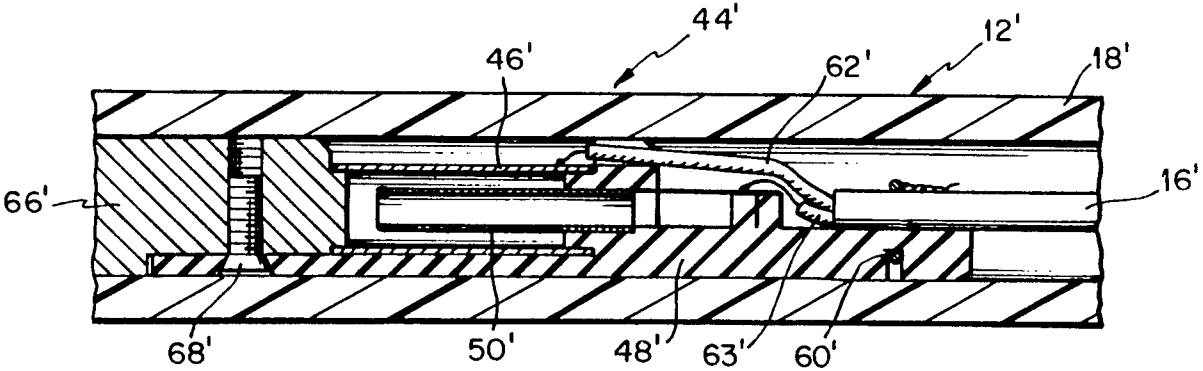
FIG. 9 is a view similar to FIG. 4 showing an alternative embodiment of a switch for incorporation in a drumstick in accordance with the invention.

In an alternative embodiment of a drum sound simulator in accordance with the invention, the trigger switch illustrated in FIG. 9 may be used to replace the trigger switch of FIG. 4. In FIG. 9, the components are functionally the same. However, the coiled spring 50' is mounted within a hollow metal tube 46' concentrically. The spring is suspended as a cantilever such that changes in motion, that is, accelerations, cause the free end of the spring 50' to swing. Whenever contact is made between the spring 50' and the metal tube 46', a circuit which extends through wire 62', 63' to cord 16' is completed. The insulating holder 48' is adapted to support the metal tube 46' and the switch spring 50' in their concentric positions. Either switch 44, 44' can be used in drumsticks 12.

Also in further alternative embodiments in accordance with the invention, the drumsticks can be replaced by other devices, for example, maracas, wherein the pebbles or beans usually contained therein are replaced by a suitably mounted switch 44, 44'. Thus, when the user shakes the maracas, a drum sound is produced from the simulator. Also, the switches 44, 44' can be adapted for attachment to the back of the fingers on each hand of the user, such that the user may slap any surface and produce drum sounds as one would play bongo drums or a tom-tom.

Figure 11:
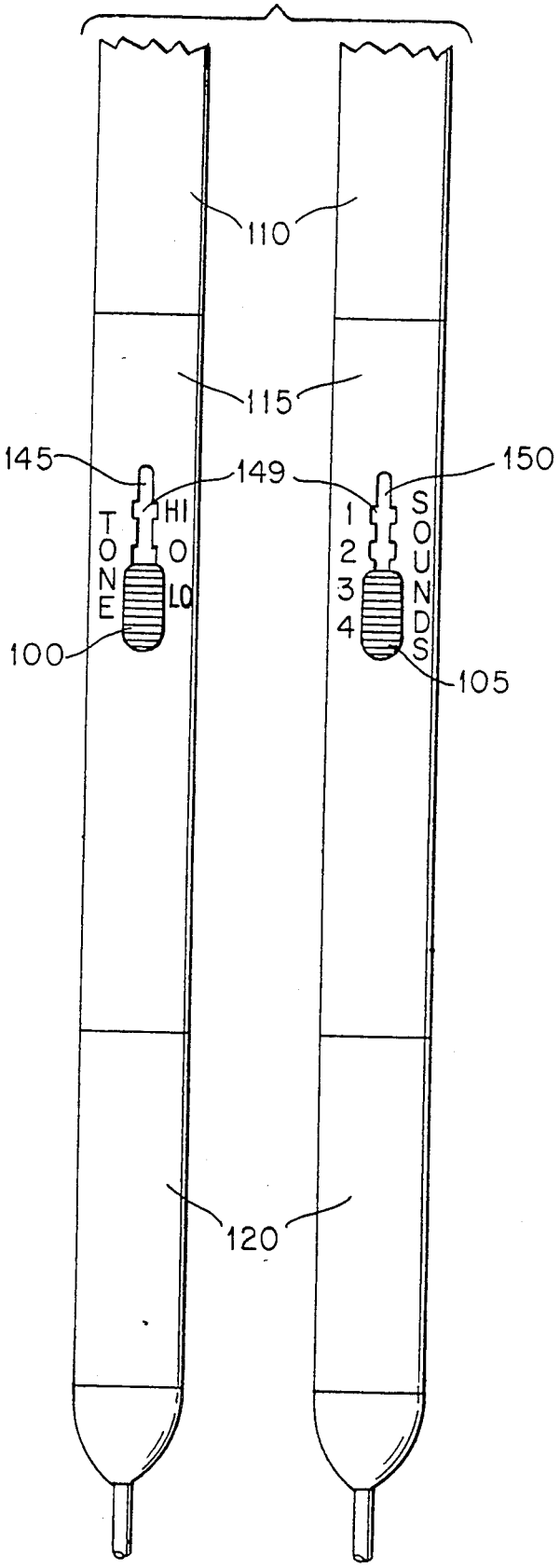
FIG. 11 is a view of drumsticks each containing switches for incorporation in an alternative embodiment in accordance with the invention.

In a further alternative embodiment of the invention shown in FIGS. 11–16, different tone pitches and drum sounds may be selected by a user. Illustratively, for this embodiment, the drumsticks shown in FIG. 11 may be used in lieu of the drumsticks of FIG. 1. As best shown in FIG. 11, a tone select switch knob 100 is used to select tone pitches and is disposed on one drumstick and a drum sound select switch knob 105 used to select drum sounds is disposed on the other drumstick. Locating of the select switch knobs on different drumsticks is done for convenience to the user, i.e., in operation, a user can select different tone pitches with one hand using a tone select switch knob 100 positioned on one drumstick and, simultaneously, select different drum sounds using the other hand, using a drum sound select switch knob 105 positioned on the other drumstick. However, it will be appreciated that the tone select switch knob 100 and drum sound select switch knob 105 can both be on the same drumstick.

Referring now more particularly to FIG. 11, each drumstick comprises a forward stick case 110, a middle stick case 115 which has notched groove openings 145 and 150 and a rear stick case 120. These drumsticks comprise three sections for ease of construction, however, drumsticks comprising one or more sections may be utilized. One of the two drumsticks is provided with a drum sound select switch and the other drumstick is provided with a tone pitch select switch. Inasmuch as the two drumsticks function substantially similarly, and are substantially similar in construction, only one drumstick which is illustrated in FIG. 12 will be described in further detail herein and is representative of both drumsticks.

Figure 12:
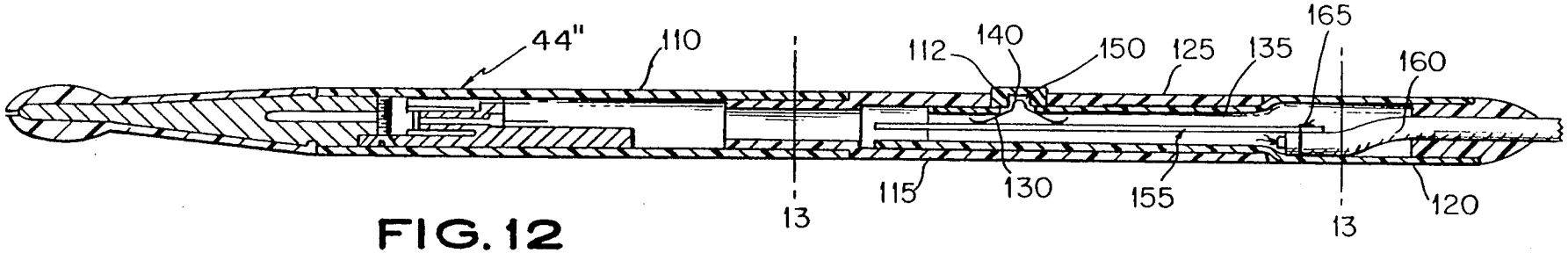
FIG. 12 is a sectional view of one of the drumsticks of FIG. 11.
Figure 13:
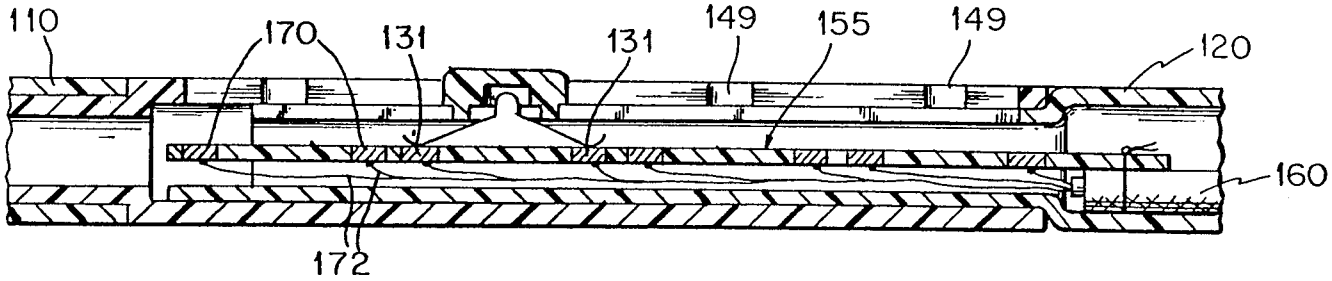
FIG. 13 is a more detailed view taken between the lines 13—13 of FIG. 12.

As shown in FIGS. 12 and 13, an inertia switch 44'' is mounted in the forward stick case 110 and is functionally identical to the inertia switch 44 shown in FIG. 4 and described in detail earlier with reference to the initial embodiment. A select switch 125 is mounted in middle stick case 115, and includes a contact leaf spring 130 which is suitably provided with a raised center portion 140 extending through a movable guide piece 135, and is capable of extending into notches 149 of a notched groove opening 150, as best shown in FIG. 11. A select switch knob 112, which represents either the tone select switch knob 100 or the drum sound select switch 105, extends through the notched groove opening 150 and is mounted to a movable guide piece 135. As the select switch knob 112 is slid along notched groove opening 150, the movable guide piece 135 and contact leaf spring 130 are likewise slid. The contact leaf spring 130 is further provided with a pair of finger contacts 131 which make contact with electrically conductive pads 170.

A printed circuit board 155 which includes the electrically conductive pads 170 is mounted in the middle stick case 115 and supports contact leaf spring 130. The contact leaf spring 130 slides along and is in pressure contact with printed circuit board 155. More particularly, printed circuit board 155 supports the contact leaf spring 130 in such a manner that the contact leaf spring 130 is under compression and maintains a constant "spring-like" character. Thus, as the contact leaf spring 130 is moved by the user and slides along and communicates with the printed circuit board 155, each instance the raised center portion 140 reaches a notch 149 of the notched groove opening 150, the spring pressure exerted by the contact leaf spring 130 causes its raised center portion 140 to extend into the notch 149 thereby "locking" the contact leaf spring 130 into a desired position until it is moved to another desired notch.

An external cord 160 passes through the rear stick case 120 and is suitably anchored to the printed circuit board 155 by, for example, a wire tie 165. Pairs of electrical wires 172 extend from the external cord 160 and are connected to the various electrically conductive pads 170. Each pair of electrical wires 172 corresponds to a different drum sound or tone pitch. Thus, four pairs of electrical wires 172 are illustrated although more or fewer pairs may be connected depending on the number of drum sounds or tone pitches employed in the practice of the invention.

As the raised center portion 140 locks into a notch 149 of the notched groove opening 150, the contact leaf spring 130 is positioned so as to communicate with a pair of electrically conductive pads 170 connected to a pair of the electrical wires 172 corresponding to a specific drum sound or tone pitch. Accordingly, each time the raised center portion 140 locks into a different notch 149 of the notched groove opening 150, the contact leaf spring 130 provides an electrical signal path between a different pair of the electrical wires 172 corresponding to a different drum sound or tone pitch.

Additionally, referring only to the tone select switch, a total of two pairs of electrical wires 172 may be connected, one pair corresponding to effecting of higher tone pitches and the other pair corresponding to effecting of lower tone pitches. Moreover, a middle notch 149, as best shown in FIG. 11, may be provided to maintain a particular tone pitch, as will be described hereinafter. Such a notch positions contact leaf spring 130 so as to provide an electrical signal path between no pair of electrical wires 172, thus maintaining a desirable tone pitch.

Figure 14:
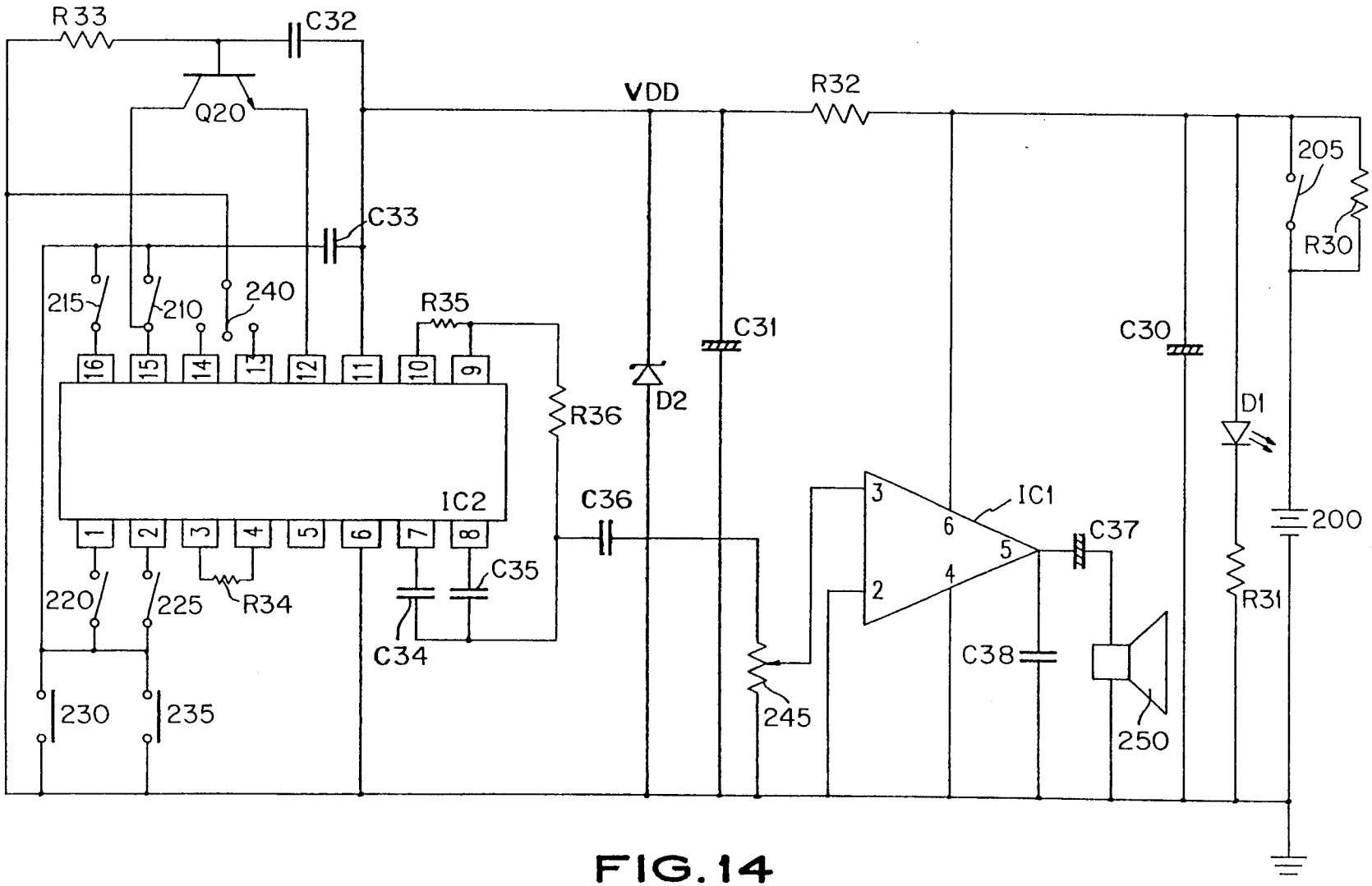
FIG. 14 is an electrical circuit of the drum sound simulator to be used with the drumsticks of FIG. 11.

FIG. 14 illustrates a circuit for the novel drum sound simulator of the invention which performs the functions of generating different drum sounds and a variable tone pitch of the drum sounds. This circuit includes a power source, such as a battery 200 grounded at its negative terminal and connected at its positive terminal to an intervening ON/OFF switch 205, with a resistor R30 connected across switch 205. Across battery 200, with intervening ON/OFF switch 205, are filter capacitor C30, and light-emitting diode D1 indicating power ON/OFF which in turn is connected in series at its anode to a resistor R31.

The battery 200 outputs at its positive terminal a voltage which is regulated by voltage regulating circuitry comprising a resistor R32, a capacitor C31 and a zener diode D2. One end of the resistor R32 is connected to the unregulated voltage of the battery 200 and to a pin 6 of an audio amplifying integrated circuit IC1 and the other end of the resistor R32 is connected to the regulated voltage identified as $V_{DD}$. The audio amplifier IC1 will be explained in greater detail hereinafter. Connected to the regulated voltage $V_{DD}$ is one end of a capacitor C31 and the anode of a zener diode D2 with the other end of the capacitor C31 and the cathode of the zener diode D2 being connected to ground.

Also connected to the regulated voltage $V_{DD}$ are two capacitors C32, C33 and a voltage supply pin 11 of a noise generating and tone varying integrated circuit IC2 which will be described in more detail hereinafter. The other end of the capacitor C33 is connected to six switches 210, 215, 220, 225, 230 and 235. Switches 210, 215, 220, and 225 are connected to an integrated circuit IC2 at drum sound selector pins 15, 16, 1 and 2, respectively.

The four switches 210, 215, 220 and 225 are normally open and represent the drum sound select switch 125 mounted in one of the drumsticks and described above. The closed position of these switches 210, 215, 220 and 225 represent the contact leaf spring 130 providing an electrical signal path between the electrical wire pairs 172 connected to the printed circuit board 155. Switches 230 and 235 represent the inertia switches 44'' mounted within the drumsticks. The other end of the capacitor C32 is connected to the base of a transistor Q20 and to one end of a resistor R33. The emitter and collector of the transistor Q20 are connected to the integrated circuit IC2 at a test pin 12 and a sound selector pin 15, respectively. The test pin 12 is connected to multiplexing circuitry of the integrated circuit IC2 and is used for testing the various components of the integrated circuit IC2. The multiplexing circuitry will be discussed in further detail hereinafter. The other end of the resistor R33 is connected to ground and to a two-way closable three-position switch 240 which is connected to the integrated circuit IC2 at tone pitch adjuster pins 13 and 14. The three-position switch 240 represents the tone pitch select switch shown mounted in one of the drumsticks. The transistor Q20, the resistor R33 and the capacitors C32, C33 reset the integrated circuit IC2 each time power is turned on.

Illustratively, one closed position of the switch 240 sets higher tone pitches, the other closed position of the switch 240 sets lower tone pitches and the open position of the switch 240 maintains tone pitch set by the two closed positions. In operation, if the closed position setting higher tone pitches is selected, each moment either inertia switch 230 or 235 closes, higher tone pitches are effected. Conversely, if the closed position setting lower tone pitches is selected, each moment either inertia switch 230 or 235 closes, lower tone pitches are effected.

Integrated circuit IC2 has an oscillator input pin 3 and an oscillator output pin 4 connected through an oscillation resistor R34. A test pin 5 is unconnected and is used for testing tone pitch outputs developed by the integrated circuit IC2. A pin 6 on the integrated circuit is grounded. Time integrator pins 7 and 8 of the integrated circuit IC2 are connected to capacitors C34 and C35, respectively, which time integrate analog signals output by the integrated circuit IC2. A signal output pin 9 is connected to output bias pin 10 through a biasing resistor R35 and signal output pin 9 is also connected to one end of a resistor R36. The other end of the capacitors C34 and C35, and the resistor R36 are connected to an amplifier input capacitor C36 which couples the integrated circuit IC2 to the audio amplifying integrated circuit IC1. The other end of capacitor C36 is connected to the resistance of a potentiometer 245 serving as volume control and the other end of the resistance of potentiometer 245 is grounded.

Inasmuch as audio amplifying integrated circuit IC1 is otherwise generally conventional in construction and design of which is not believed to require any further description herein. However, as shown herein, audio amplifying integrated circuit IC1 has pin 3 connected to a potentiometer 245, pins 2 and 4 grounded and pin 5 connected to the capacitors C37 and C38. The other end of the capacitor C38 is grounded and the other end of the capacitor C37 is connected to a loudspeaker 250.

Figure 15:
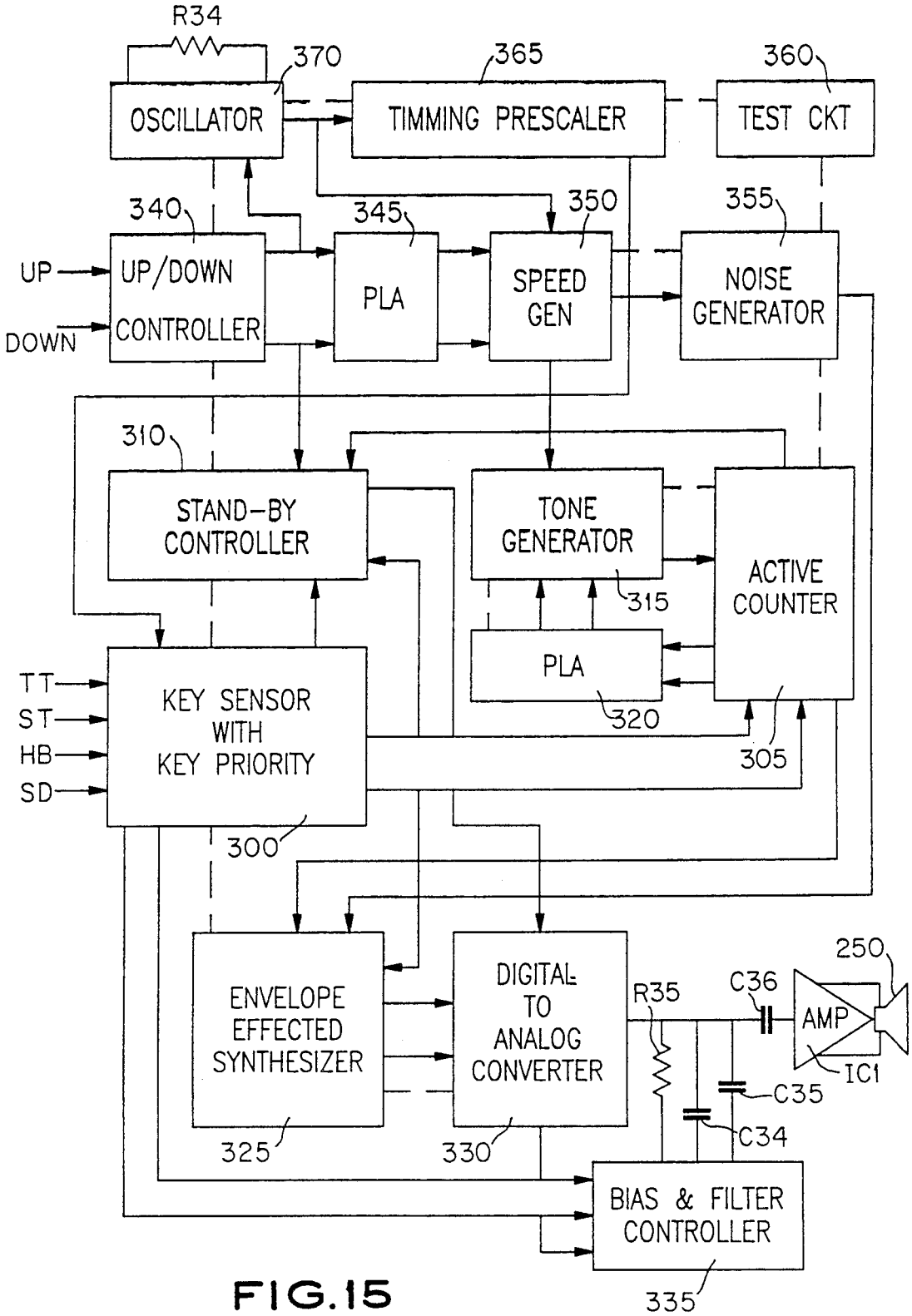
FIG. 15 is a functional block diagram of a drum sound generator to be used in the electrical circuit of FIG. 14.
Figure 16B:
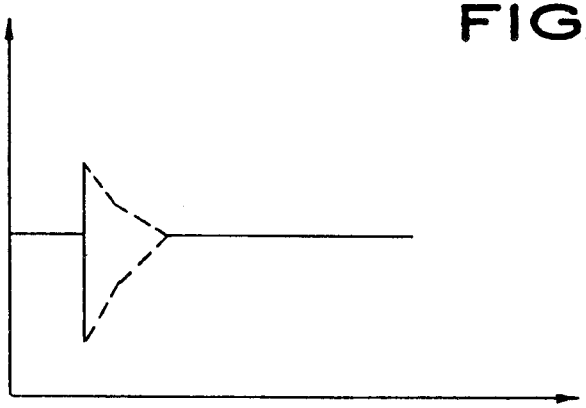
FIG. 16(*a*)-(*d*) are diagram of waveforms developed by the drum sound generator of FIG. 15.
Figure 16D:
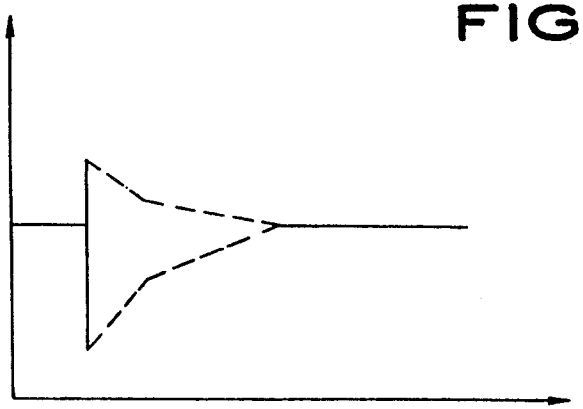
Figure 16A:
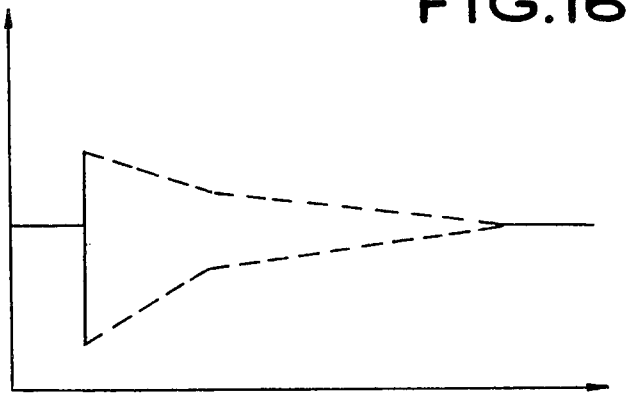
Figure 16C:
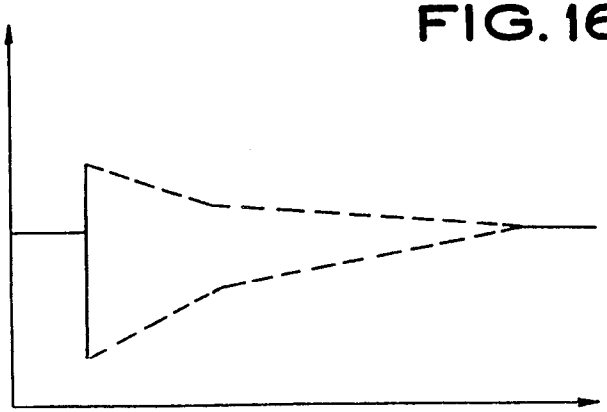

Referring now to FIG. 15, there is shown in greater detail a block diagram of the noise generating and tone varying integrated circuit IC2. An oscillator 370 generates a system clock having a frequency, for example, of 512 KHZ, although adjustable by an external resistance R34. The oscillator 370 outputs the clock signal to a timing prescaler 365 and a speed generator 350. The timing prescaler 365 divides the clock signal frequency, for example, from 512 KHZ to 128 HZ, and outputs the frequency divided clock signal to a key sensor 300.

An up/down controller 340 controls tone pitch and includes a counter each increment of which corresponds to a different tone pitch. In the preferred embodiment, the counter comprises eleven increments corresponding to eleven different tone pitches, although more or fewer increments may be implemented depending on the number of possible tone pitches. A first programmable logic array (PLA) 345 having a scale, for example, of $11 \times 6$ bits accepts an output signal from the up/down controller 340 and converts the output signal to a code appropriate for outputting to the speed generator 350. The speed generator 350 is a frequency divider which receives, from the first programmable logic array 345, the output code which is used to determine a value by which the system clock frequency is to be divided so as to generate a signal indicating a frequency appropriate for developing a selected tone pitch. In the preferred embodiment, the speed generator 350 comprises six sets of parallel in/parallel out shift registers generating eleven different output signals which are 1/45, 1/43, 1/40, 1/38, 1/36, 1/34, 1/32, 1/30, 1/28, 1/27 and 1/25 of the frequency of the system clock generated by the oscillator 370. A noise generator 355 and a tone generator 315 receive the output signal from the speed generator 350. In the preferred embodiment, the noise generator 355 comprises nine flip-flops producing a set of random binary digits for generating random noise, and the tone generator 315 comprises seven sets of parallel in/parallel out shift registers.

Selection of a drum sound by a user activates an appropriate key. The number of keys depends on the number of drum sounds capable of being generated. In the preferred embodiment, four drum sounds are possible and more particularly those of a tom tom, a syn tom, a high bongo and a snare drum, although more or fewer drum sounds may also be provided, if desired. The key sensor 300 senses which key is activated thereby determining which drum sound will be generated. The key sensor 300 scans the keys at a frequency, illustratively, of 128 HZ as set by the timing prescaler 365. Scanning is conducted according to a pre-determined key priority sequence so that if more than one key is selected at any one time, then the key with the higher priority will determine the drum sound to be generated. An active counter 305 receives the output signal from the key sensor 300 and from the tone generator 315, and outputs a signal to a second programmable logic array (PLA) 320. As the key sensor 300 senses that a key has been activated and outputs the signal to the active counter 305, the tone generator 315 outputs to the active counter 305 a signal which determines the frequency at which the active counter 305 is to select and output signals representing addresses of appropriate drum sound data to the second programmable logic array 320 so as to satisfy timing requirements for different tone pitches. The second programmable logic array 320 having a scale, for example, of $67 \times 7$ bits receives the output signals from the active counter 305 which it converts to a code appropriate for outputting to the tone generator 315. Particularly, tone pitch is determined by the frequency at which the active counter 305 outputs signals to the second programmable logic array 320. If the active counter 305 outputs signals to the second programmable logic array 320 at a high frequency, then the time period of drum sound generation is short thus resulting in a high tone pitch. Conversely, if the active counter 305 outputs signals to the second programmable logic array 320 at a low frequency, then the time period of drum sound generation is long thus resulting in a low tone pitch.

A stand-by controller 310 receives the output signals from the active counter 305, the key sensor 300 and an envelope effected synthesizer 325, and outputs signals to the oscillator 370 and a digital-to-analog converter 330. The stand-by controller 310 includes a latch so that when the key sensor 300 senses that no key has been activated, the latch is at a stand-by status causing the digital-to-analog converter 330 and the oscillator 370 to be in an inactive state; and when the key sensor 300 senses that a key has been activated, the latch outputs signals received from the active counter 305 and the envelope effected synthesizer 325 to the oscillator 370 and digital-to-analog converter 330 causing them to be activated. Additionally, at the end of each drum sound output, the active counter 305 outputs a signal to the stand-by controller 310 indicating that it should reset and again the latch is at a stand-by status causing the digital-to-analog converter 330 and the oscillator 370 to be in an inactive state.

The envelope effected synthesizer 325 receives output signals from the noise generator 355 and the active counter 305. The output signal received from the active counter 305 is formed and trimmed to develop an appropriate tone pitch; and the output signal received from the noise generator 355 is envelope and amplitude shaped to develop the appropriate drum sounds desired in the practice of the invention.

The digital-to-analog converter 330 receives the digital output signal from envelope effected synthesizer 325 and converts it to an analog output signal which is output to bias and filter controller 335 and to amplifier input capacitor C36 which connects to audio amplifier IC1. Illustratively, digital-to-analog converter 330 is of a five bit current complimenting type. Biasing circuitry of bias and filter controller 335 controls "pop" sounds of digital-to-analog converter 330 during conversion. Filtering circuity of bias and filter controller 335 controls connecting of the capacitors C34 and C35, which time integrate the analog output signal. Note that the capacitors C34 and C35 are connected to pins 7 and 8 of the integrated circuit IC2, respectively, and the resistor R35 connects pins 9 and 10 of the integrated circuit IC2, as shown in FIG. 14. More particularly, the resistor 35 provides load and the capacitors C34 and C35 provide different integration time constants for different drum sounds. Additionally, the amplifier input capacitor C36, the audio amplifier IC1 and the loudspeaker 250 are also shown in FIG. 14.

Additionally, a multiplexing test circuit 360 is provided which allows for testing of the entire integrated circuit IC2 using the test pin 12 shown in FIG. 14. Particularly, the multiplexing test circuit is connected to the various components of the integrated circuit IC2 and is capable of switching from one component to another thereby allowing for testing of each component using the one test pin 12.

Illustratively, four drum sounds may be generated by the drum sound generator, specifically, tom tom, syn tom, snare drum and high bongo. The sound waveform envelopes of these four sounds developed by the drum sound generator are illustrated in FIG. 16(*a*)–(*d*). In accordance with the invention, preferable sound waveform envelopes to develop the four sounds are provided in terms of voltage versus time, although different sound waveform envelopes can be developed to simulate other drum sounds or other musical sounds.

What is claimed is:

1. A portable drum sound simulator comprising:

a portable enclosure having therein drum sound generating means comprising an electronic circuit having a power source and energizable in response to momentary electrical trigger signals for generating two different audible drum-like sound outputs each in response to a corresponding trigger signal;

a sound select switch connected to the electronic circuit and having means for selectively selecting which said drum-like sound output the drum sound generating means generates;

tone pitch varying means connected in the electronic circuit for varying the tone pitch of generated drum-like sound outputs;

a tone select switch connected to the tone pitch varying means comprising means for selecting a higher tone pitch than one previously set, means for selecting a lower tone pitch than one previously set and means for maintaining a selected tone pitch;

two normally open independently activated switches connected to the electronic circuit and momentarily closable for developing the momentary electrical trigger signals for independently effecting energizing of the drum sound generating means when momentarily closed and generating the drum-like sound outputs; and two drumsticks each having a corresponding one of the two independently activated switches and movable in a striking motion in any desired direction at an accelerated velocity and decelerated at a certain rate momentarily at will while moving in said any direction for effectively generating the electrical trigger signals, each said independently activated switch having means for detecting momentary deceleration of the corresponding drumstick and effecting momentary closing of the corresponding switch in response to the detection of the momentary decelerations and effecting generating of the momentary electrical trigger signals.

2. A portable drum sound simulator according to claim 1, wherein said sound select switch comprises two normally open contacts each corresponding to a respective drum-like sound output and each alternatively closable for selecting a corresponding drum-like sound output.

3. A portable drum sound simulator according to claim 1, wherein said tone select switch includes a normally open contact closable for selecting a higher tone pitch than one previously set and another normally open contact closable for selecting a lower tone pitch than one previously set.

4. A portable drum sound simulator according to claim 1, wherein said drum sound generating means comprises a random noise generator generating a signal representing random noise and means for envelope and amplitude shaping the signal generated by the random noise generator for generating audible drum-like sound outputs.

5. A portable drum sound simulator according to claim 1, wherein said drum sound generating means generates two additional drum-like sound outputs and said sound select switch includes means for selectively selecting which of the two additional drum-like sound outputs the drum sound generating means generates.

6. A portable drum sound simulator according to claim 1, wherein said tone pitch varying means comprises means for controlling the time period of drum sound generation for varying the tone pitch of generated drum-like sound outputs as a function of the time period of drum sound generation.

7. A portable drum sound simulator according to claim 1, wherein said power source is a battery.

8. A portable drum sound simulator according to claim 1, wherein one of said drumsticks has mounted thereon said tone select switch and the other of said drumsticks has mounted thereon said sound select switch.

9. A portable drum sound simulator according to claim 1, wherein said drum sound simulator includes means for suspending the simulator on a user thereof.

* * * * *